US006340094B1

(12) United States Patent
Kawamura

(10) Patent No.: US 6,340,094 B1
(45) Date of Patent: Jan. 22, 2002

(54) PREMIUM SUPPLY APPARATUS AND LOCK MECHANISM OF HOOK FOR PREMIUM SUPPLY APPARATUS

(75) Inventor: Kozo Kawamura, Tokyo (JP)

(73) Assignee: Sammy Corporation, Tokyo (JP)

( * ) Notice: Subject to any disclaimer, the term of this patent is extended or adjusted under 35 U.S.C. 154(b) by 0 days.

(21) Appl. No.: 09/529,250

(22) PCT Filed: Jun. 2, 1998

(86) PCT No.: PCT/JP98/02433

§ 371 Date: Apr. 10, 2000

§ 102(e) Date: Apr. 10, 2000

(87) PCT Pub. No.: WO99/21140

PCT Pub. Date: Apr. 29, 1999

(30) Foreign Application Priority Data

Oct. 17, 1997 (JP) ..... 9-285644

(51) Int. Cl.[7] ..... G07F 11/00

(52) U.S. Cl. ..... 221/79; 221/87; 221/88

(58) Field of Search ..... 221/79, 80, 87, 221/88, 113, 119, 121, 123, 133, 289, 312 A

(56) References Cited

U.S. PATENT DOCUMENTS

| | | | | | |
|---|---|---|---|---|---|
| 3,709,404 | A | * | 1/1973 | Dana | 221/120 |
| 3,757,993 | A | * | 9/1973 | Bruckner et al. | 221/80 |
| 3,762,602 | A | * | 10/1973 | Wasil | 221/195 |
| 3,811,745 | A | * | 5/1974 | Cylke | 312/13 |
| 3,830,409 | A | * | 8/1974 | Jenkinson | 221/236 |
| 4,244,568 | A | | 1/1981 | Ferris et al. | 273/1 R |
| 5,240,142 | A | * | 8/1993 | Reid | 221/129 |
| 5,344,042 | A | * | 9/1994 | Crosby et al. | 221/2 |
| 5,558,340 | A | * | 9/1996 | Ibe et al. | 273/448 |
| 5,848,935 | A | * | 12/1998 | Noell et al. | 463/16 |
| 6,283,324 | B1 | * | 1/1999 | Jenkins et al. | 221/192 |
| 5,908,428 | A | * | 6/1999 | Scirica et al. | 606/139 |
| 5,931,340 | A | * | 8/1999 | Savage et al. | 221/88 |
| 6,098,839 | A | * | 8/2000 | Hunnell | 221/197 |

FOREIGN PATENT DOCUMENTS

DE 3333356 A1 3/1984

* cited by examiner

*Primary Examiner*—Christopher P. Ellis
*Assistant Examiner*—Rashmi Sharma
(74) *Attorney, Agent, or Firm*—Wolf, Greenfield, & Sacks, P.C.

(57) ABSTRACT

A lock mechanism for a hook in which a premium suspended in a hook can be taken out at a predetermined drop position within a casing is provided. The mechanism comprises a base member (40), a hook (10) fixed to the base body (40), and a lock portion (20) for closing an open portion in the hook (10) at the portion other than the predetermined drop position, the lock portion (20) comprises a support point portion (21) axially supported to the base body (40), a rotating piece (22) capable of rotating to both of normal and inverse directions around the support point portion (21) and an operating portion (50) for rotating the rotating piece (22), and the rotating piece (22) is structured such that an end portion thereof is brought into contact with the hook (10) at the position other than the predetermined drop position and at the predetermined position, the rotating piece (22) is rotated so that the premium (60) can move.

6 Claims, 5 Drawing Sheets

PREMIUM SUPPLY APPARATUS AND LOCK MECHANISM OF HOOK FOR PREMIUM SUPPLY APPARATUS

FIELD OF THE INVENTION

The present invention relates to a premium supply apparatus structured such as to supply a premium suspended in a hook provided within a casing in response to a game result and a lock mechanism for a hook so that a premium can drop down at a predetermined drop position within the casing.

BACKGROUND OF THE INVENTION

Conventionally, there is an apparatus in which a moving base body having a hook-shaped hook fixed is provided within a casing of a game machine, a premium is suspended to the hook and the premium is dropped down at a predetermined drop position within the casing. At the predetermined drop position within the casing, a rod-like resistance bar is provided on an opposite side to the moving base body with respect to the hook. The resistance bar is formed in such a manner as to be able to stop an integral movement of the premium with the hook by contacting with the premium suspended in the hook.

Then, when the moving base body is moved and the premium suspended in the hook reaches the predetermined drop position within the casing of the game machine, the premium is in contact with the resistance bar, so that the movement is stopped. On the contrary, the hook still keeps moving together with the moving base body. As a result, the premium is taken out from the hook in the front end of the advancing direction of the hook on the basis of the resistance bar, and the premium drops down at the predetermined drop position within the casing.

However, in the art mentioned above, there have been the following problems.

Accordingly, since the hook is formed in a hook shape, the hook is positioned within the casing in a state that an opening portion thereof is open. Accordingly, there has been a problem that the premium is dropped down even at the other position than the predetermined drop portion, in the case that the casing is swung or the premium is not sufficiently locked with respect to the hook.

Further, the premium is taken out from the hook by bringing the premium into contact with the resistance bar, however, there has been a problem that an erroneous motion, that is, the premium overrides the resistance bar and is not taken out from the hook, is generated.

SUMMARY OF THE INVENTION

Accordingly, an object in accordance with the invention as recited in claim 1 is to provide a lock mechanism for a hook in which a premium can be taken out from a hook at a predetermined drop position within a casing and the premium is prevented from dropping down from the hook at the other position than the predetermined drop position.

Further, in addition, an object in accordance with the invention as recited in claim 2 is to provide a lock mechanism for a hook in which a premium can be taken out from a hook at a predetermined drop position within a casing even in the case that the hook relatively moves with respect to the predetermined drop position and the premium is prevented from dropping down from the hook at the other position than the predetermined drop position.

Still further, in addition, an object in accordance with the invention as recited in claim 3 is to provide a lock mechanism which can securely take out a premium from a hook.

Furthermore, in addition, an object in accordance with the invention as recited in claim 4 is to provide a lock mechanism which can be easily mounted to a base body.

Moreover, an object in accordance with the invention as recited in claim 5 is to provide a premium supply apparatus in which a premium can be taken out from a hook at a predetermined drop position within a casing and the premium is prevented from dropping down from the hook at the other position than the predetermined drop position.

The invention is provided so as to achieve the objects mentioned above.

(Claim 1)

A lock mechanism for dropping down a premium 60 suspended in a base body 40 at a predetermined drop position and for preventing the premium 60 from dropping down at the other position than the predetermined drop position, comprising a base member 40, a hook 10 fixed to the base body 40, suspending the premium 60 and capable of maintaining a state of being easily dropped, and a lock portion 20 for preventing the premium 60 from dropping down by closing an open portion in the hook 10, wherein the lock portion 20 comprises a support point portion 21 axially supported to the base body 40, a rotating piece 22 capable of rotating to both of normal and inverse directions around the support point portion 21 and an operating portion 50 for rotating the rotating piece 22, and the rotating piece 22 is structured such that an end portion thereof is brought into contact with the hook 10 at the position other than the predetermined drop position so as to close the open portion and at the predetermined position, the rotating piece 22 is rotated to a position which does not prevent the premium 60 from dropping down from the hook 10 so that the premium 60 can be taken out.

In this case, the wording "(the hook 10 is) fixed to the base body 40" means that the hook 10 capable of integrally moving with the base body 40 is sufficient. Accordingly, in the case that the base body 40 is at a standstill, the hook 10 is also at a standstill, in the case that the base body 40 can be moved as defined in claim 2, it is sufficient that the hook 10 can move in an integral manner with the movement of the base body 40, and in addition to the case that the hook 10 is brought into contact with the base body 40 and fixed thereto, the case that the hook 10 is formed in a such a manner as to be attached to and detached from the base body 40 and can be integrally moved with the base body 40 during the movement of the base body 40 are included.

An operation of the invention as recited in claim 1 will be described.

Since the open portion of the hook 10 is closed at the portion other than the predetermined position, the premium 60 is prevented from dropping down from the hook 10. On the contrary, at the predetermined drop position, the rotating piece 22 rotates and the premium 60 can be dropped down from the hook 10. Accordingly, the premium 60 can be dropped down from the hook 10 at the predetermined drop position by controlling a motion of the operating portion 50, and at the position other than the predetermined drop position, the premium 60 can be prevented from dropping down from the hook 10.

(Claim 2)

The invention as recited in claim 2 is the invention technically restricting the invention as recited in claim 1, in which a resistance portion 30 relatively moving with respect to the base body 40 is provided at the predetermined drop position for dropping down the premium 60, and the resistance portion 30 is formed in a shape for guiding the premium 60 to the open portion in the hook 10 by contacting with the premium 60 and is provided at a position which does not prevent the premium 60 from dropping down from the hook 10.

In this case, the wording "a resistance portion 30 relatively moving with respect to the base body 40" means that the resistance portion 30 is formed such that the base body 40 is not relatively at a standstill with respect to the resistance portion 30. For example, in addition to the case that the base body 40 moves with respect to the standstill resistance portion 30 and the case that the resistance portion 30 moves with respect to the standstill base body 40, the case that the resistance body 30 and the base body 40 move at a different speed and to a different moving direction is included.

An operation of the invention as recited in claim 2 will be described.

When the base body 40 relatively moves with respect to the resistance portion 30 so as to reach the predetermined drop position, the premium 60 is brought into contact with the resistance portion 30, so that an integral movement with the base body 40 is stopped. On the contrary, since the hook 10 is fixed to the base body 40, it moves together with the base body 40.

Accordingly, since the open portion of the hook 10 is open at the predetermined drop position in such a manner that the lock portion 20 does not prevent the premium from dropping down, the premium 60 can be taken out from the hook 10.

(Claim 3)

The invention as recited in claim 3 is the invention technically restricting the invention as recited in claim 2, in which the resistance portion 30 is provided with a main body portion 31 positioned at an opposite side to the base body 40 with respect to the hook 10 and contacting with the premium 60, and a side support portion 32 projecting to a direction of the base body 40 from the main body portion 31, and the side support portion 32 is formed in such a manner that an upper end portion thereof is at a position higher than an open end 11 of the hook 10 in the predetermined drop position.

An operation of the invention as recited in claim 3 will be described.

The premium can be securely taken out from the hook 10 due to the presence of the side support portion 32.

(Claim 4)

The invention as recited in claim 4 is the invention technically restricting the invention as recited in claim 2 or claim 3, in which the operating portion 50 comprises a projecting piece 53 fixed to a rotating piece 22 of the lock portion 20, a rotating function portion 51 contacting with the projecting piece 53 in a front side of an advancing direction of the base body 40 so as to rotate and move the projecting piece 53 with respect to the resistance portion 30, and a keeping function portion 52 for keeping a state that the projecting piece 53 rotates until the open portion of the hook 10 is positioned at a back side of the advancing direction of the base body 40 in comparison with the resistance portion 30.

An operation of the invention as recited in claim 4 will be described.

The base body 40 moves toward the resistance portion 30. In this state, the rotating piece 22 closes the open portion of the hook 10. When the projecting piece 53 is brought into contact with the rotating function portion 51 so as to rotate, the rotating piece 22 rotates together with the projecting piece 53, so that the open portion of the hook 10 is opened. Further, when the base body 40 moves toward the resistance body 30, the premium 60 is brought into contact with the resistance portion 30, so that the integral movement of the premium 60 with the base body 40 is prevented. Then, in the state that the premium 60 stays in the front side of the advancing direction of the base body 40 in the resistance portion 30, the hook 10 further moves together with the base body 40. As a result, as well as the premium 60 can be dropped down at the predetermined position, the premium 60 can be prevented from dropping down at the position other than the predetermined position.

Further, the rotating piece 22 can be rotated due to a mechanical structure using the movement of the base body 40. Accordingly, an electrically connecting operation for operating the lock mechanism is not required, and an operation of mounting the lock mechanism to the base body 40 can be made simple.

(Claim 5)

A premium supply apparatus comprising a box-like casing 70, a base body 40 provided within the casing 70, a hook 10 fixed to the base body 40, suspending a premium 60 and capable of maintaining a state of being easily dropped, a lock portion 20 for preventing the premium 60 from dropping down by closing an open portion in the hook 10, a resistance portion 30 relatively moving with respect to the base body 40 provided at the predetermined drop position for dropping down the premium 60 within the casing 70, a discharge passage 80 for discharging the premium 60 dropping down the predetermined drop position to an outer portion of the casing 70, and a discharge port 81 disposed at an end portion of the discharge passage 80 and communicating with the outer portion of the casing 70, wherein the lock portion 20 comprises a support point portion 21 axially supported to the base body 40, a rotating piece 22 capable of rotating to both of normal and inverse directions around the support point portion 21 and an operating portion 50 for rotating the rotating piece 22, and the rotating piece 22 is structured such that an end portion thereof is brought into contact with the hook 10 at the position other than the predetermined drop position so as to close the open portion and at the predetermined position, the rotating piece 22 is rotated to a position which does not prevent the premium 60 from dropping down from the hook 10 so that the premium 60 can be taken out, and wherein the resistance portion 30 is formed in a shape for guiding the premium 60 to the open portion in the hook 10 by contacting with the premium 60 and is provided at a position which does not prevent the premium 60 from dropping down from the hook 10.

An operation of the invention as recited in claim 5 will be described.

Since the open portion of the hook 10 is closed at the portion other than the predetermined position within the casing 70, the premium 60 is prevented from dropping down from the hook 10. On the contrary, at the predetermined drop position, the rotating piece 22 rotates and the premium 60 can be dropped down from the hook 10. Then, the premium 60 dropped down at the predetermined drop position reaches the discharge port 81 through the discharge passage 80, and the premium 60 can be taken out to the outer portion of the casing 70 from the discharge port 81.

Accordingly, the premium 60 can be dropped down from the hook 10 at the predetermined drop position by controlling a motion of the operating portion 50, as well as at the position other than the predetermined drop position, the premium 60 can be prevented from dropping down from the hook 10, and further, the dropped premium 60 can be taken out to the outer portion of the casing 70.

DETAILED DESCRIPTION

Figure 1:
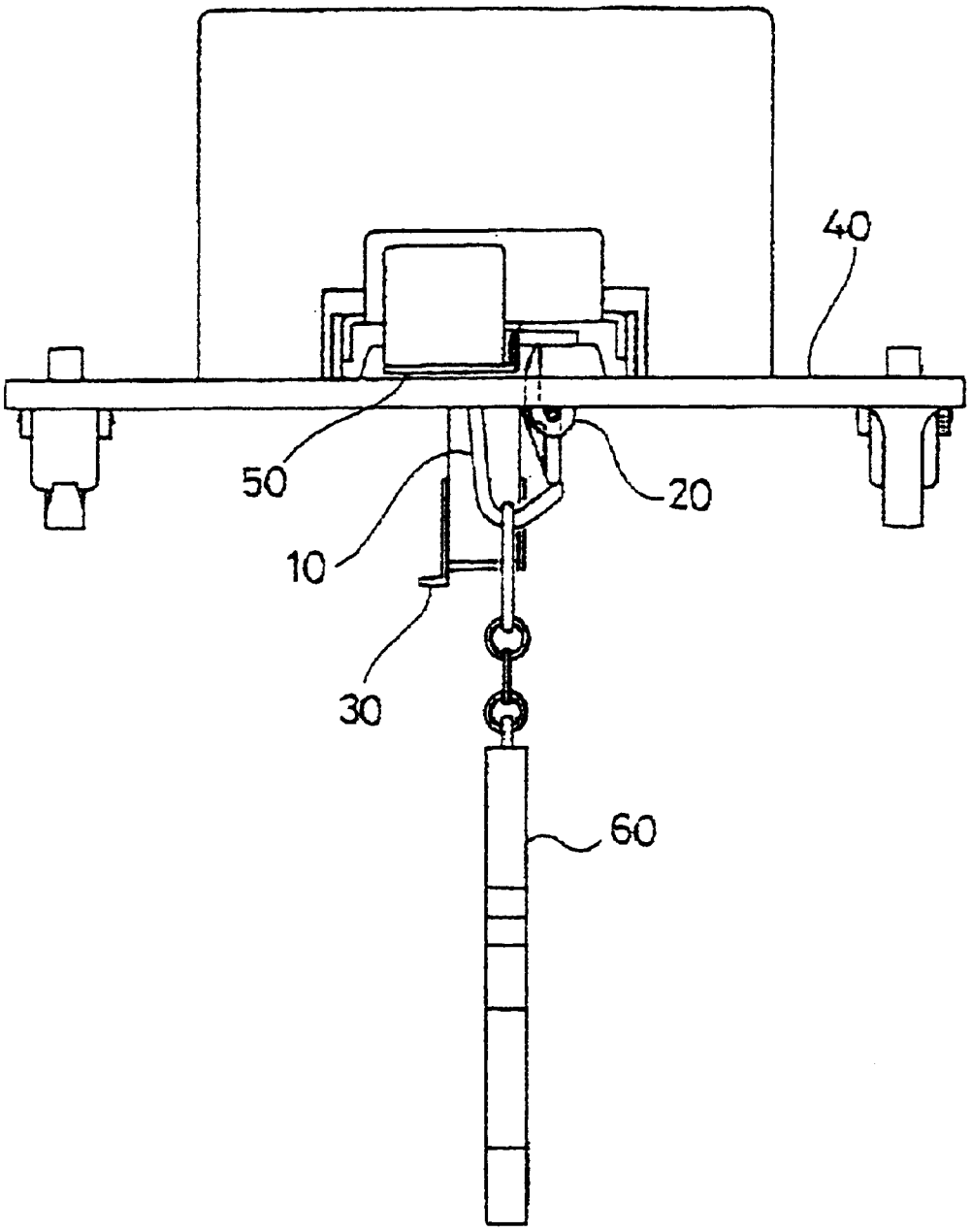
FIG. 1 is a side elevational view which shows an embodiment in accordance with the invention.
Figure 2:
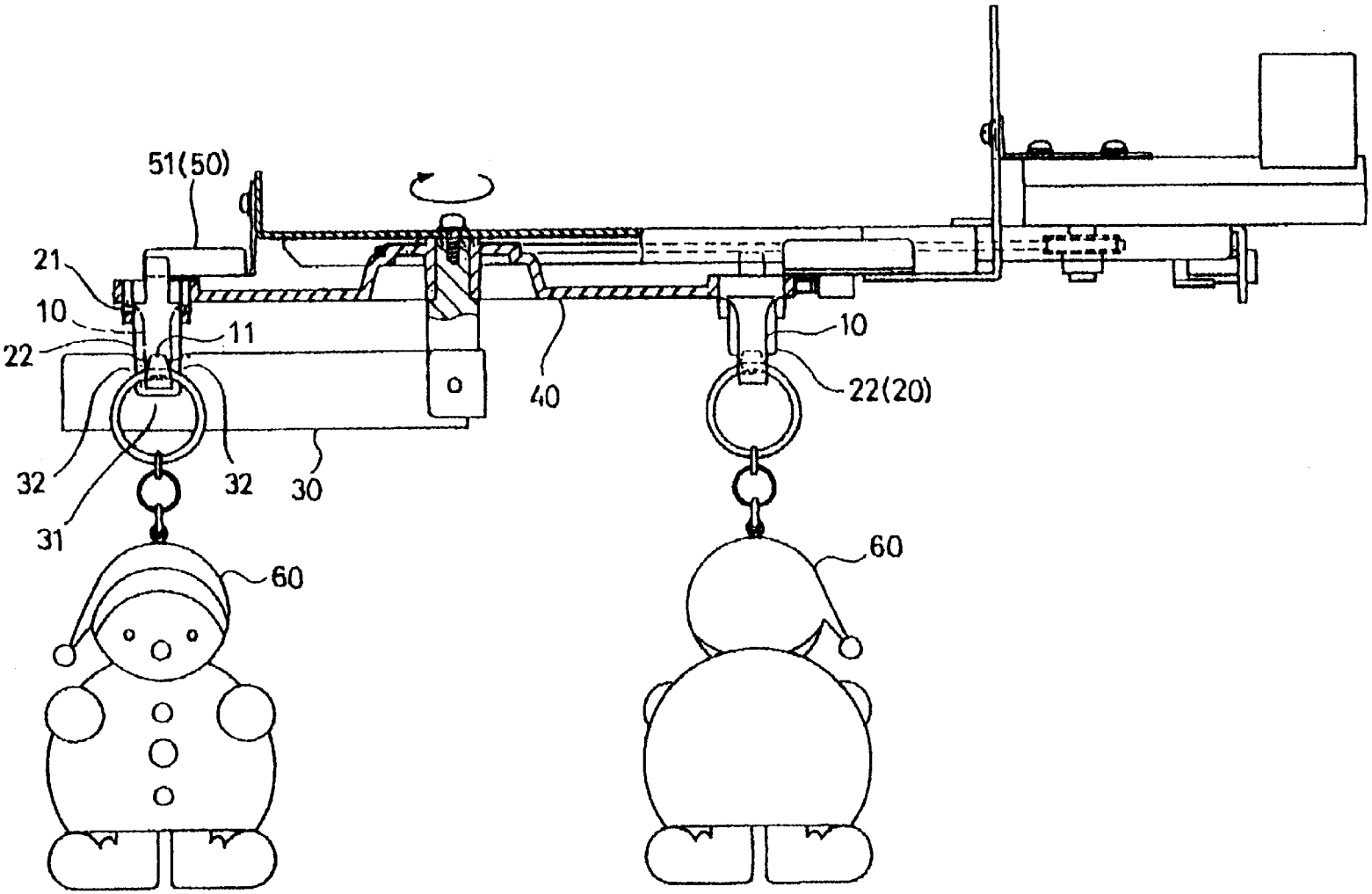
FIG. 2 is a vertical cross sectional view which shows an embodiment in accordance with the invention.
Figure 3:
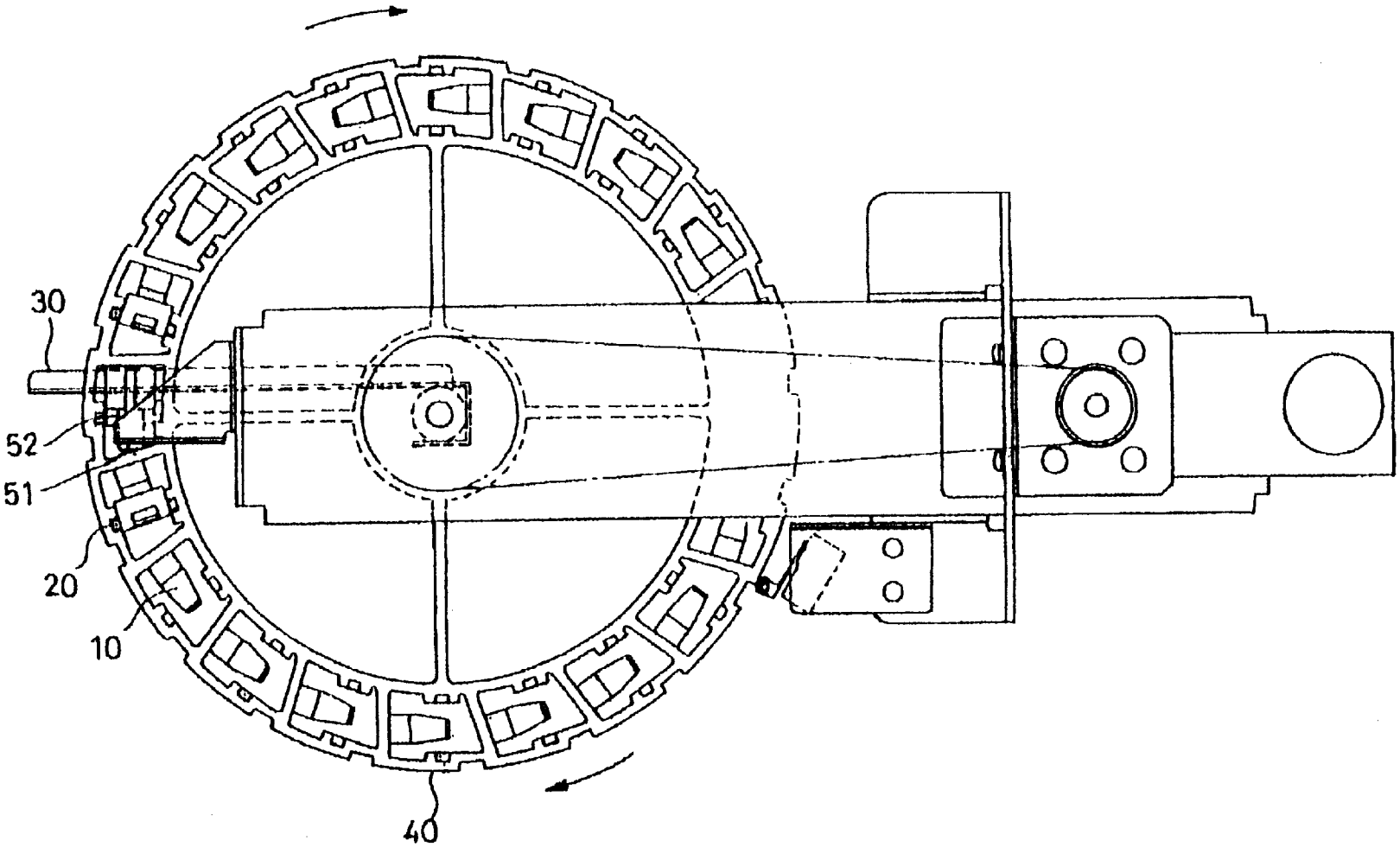
FIG. 3 is a plan view which shows an embodiment in accordance with the invention.
Figure 4:
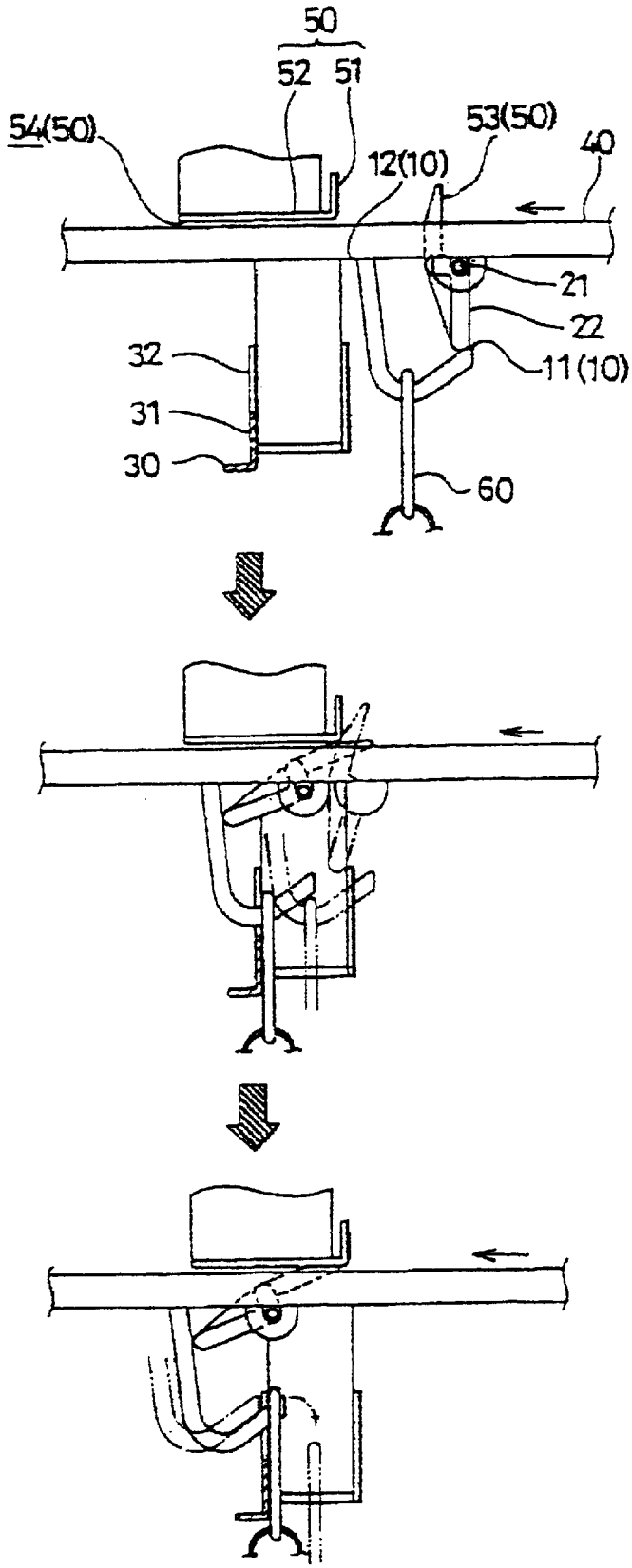
FIG. 4 is a schematic view which shows an embodiment in accordance with the invention.
Figure 5:
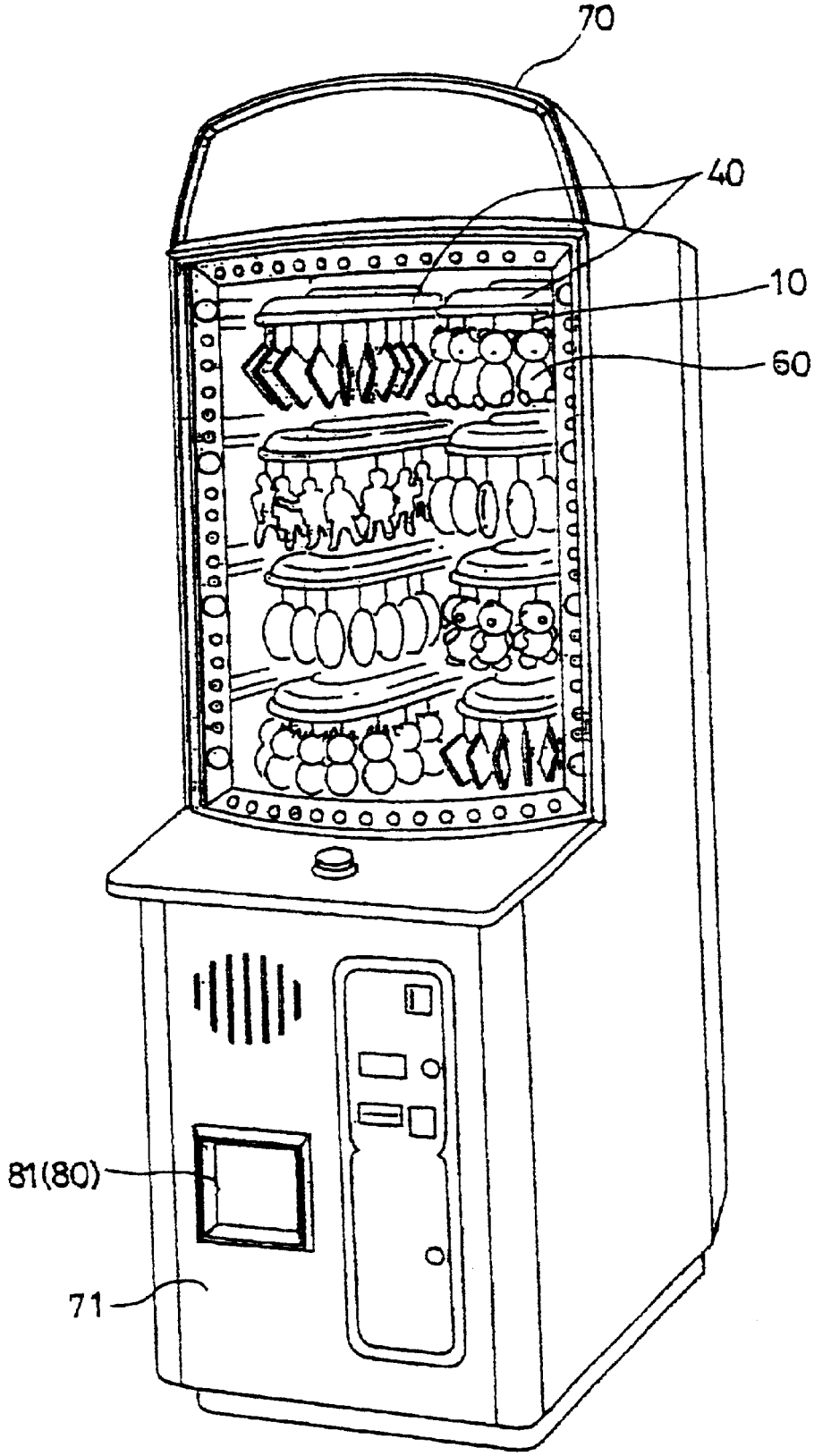
FIG. 5 is a totally perspective view which shows an embodiment in accordance with the invention.

An embodiment of the invention will be described below further in detail with reference to the drawings. The drawings used here are FIGS. 1, 2, 3, 4 and 5. FIG. 1 is a side elevational view for showing an embodiment in accordance with the invention, which shows a summary of a whole of a base body. FIG. 2 is a vertical cross sectional view for showing an embodiment in accordance with the invention, which shows a positional relation between a lock portion and a resistance portion. FIG. 3 is a plan view for showing an embodiment in accordance with the invention, which shows a summary of a whole of the base body. FIG. 4 is a schematic view for showing an embodiment in accordance with the invention, which shows an operating state of the lock portion. FIG. 5 is a totally perspective view for showing an embodiment in accordance with the invention, which shows a summary of a casing 70 of a game machine.

A premium supply apparatus shown in FIG. 5 corresponds to an apparatus for supplying a premium 60 within a box-like casing 70 when the operator wins a prize in a game. Concretely speaking, the apparatus is provided with the box-like casing 70, a plurality of disc-like base bodies 40, 40, . . . disposed within the casing 70 and rotating in a horizontal direction, and hooks 10, 10, . . . fixed to the base body 40. The premium 60 is suspended in each of the hooks 10. The base body 40 is provided with a lock portion 20 capable of dropping down the premium suspended in the hook 10 at a predetermined drop position within the casing 70.

Further, a resistance portion 30 for dropping down the premium from the hook 10 by contacting with the premium 60 is provided at the predetermined drop position within the casing 70. Still further, the casing 70 is provided with a discharge passage 80 for discharging the premium 60 dropped down from the hook 10 at the predetermined drop position within the casing 70 to an outer portion of the casing 70. The discharge passage 80 is communicated with a discharge port 81 provided in a front surface 71 of the casing 70.

The casing 70 is provided with a control apparatus for performing a calculation operation of a game, an illustration of which is omitted. The control apparatus is provided with an input apparatus for inputting an execution condition for a game, a calculating apparatus for calculating on the basis of the input condition and an output apparatus for outputting a calculating result. When a command of supplying the premium 60 is output from the output apparatus as a result of the calculation processing under the given condition, the lock portion 20 of the hook 10 is released in accordance that the base body 40 moves, so that the premium 60 is taken out from the hook 10. Then, the premium 60 is discharged from the discharge port 81 through the discharge passage 80, and can be taken out from the outer portion of the casing 70.

(Base Body)

As shown in FIG. 3, the base body 40 is rotatably formed such that a horizontal cross sectional shape thereof is a substantially hollow circular shape and a rotating axis thereof is in parallel to a perpendicular direction. As shown in FIG. 1, a plurality of hooks 10 having a vertical cross sectional shape projecting downward from the body 40 formed substantially in a J shape are provided in a lower end portion of the base body 40. An upper end portion of the hook 10 is made a fixed end fixed to the base body 40, and the other end is made an open end 11 capable of taking out the premium 60 locked to the hook 10 from the hook 10. The hook 10 is formed in such a manner as to suspend the premium 60 and to keep a state of being simply dropped down. A ring is provided in an upper portion of the premium 60, and the ring is locked to the hook 10, thereby suspending the premium 60 to the hook 10.

(Lock Mechanism)

The base body 40 is provided with the lock mechanism 20 for dropping down the premium 60 suspended in the hook 10 at the predetermined drop position and for preventing the premium 60 from dropping down from the hook 10 at the position other than the predetermined drop position. The lock portion 20 can be detachably mounted to the base body 40. The lock portion 20 is structured such as to mount the lock portion 20 along a peripheral edge of the base body 40, however, in FIG. 3, the lock portion 20 is illustrated in a partly omitted manner.

The lock portion 20 is provided with a support point portion 21 axially supported to the base body 40, a rotating piece 22 capable of rotating to both of a normal and an inverse directions around the support point portion 21 and an operating portion 50 for rotating the rotating piece 22. A lower end portion of the rotating piece 22 is positioned below the open end 11 of the hook 10. Further, a projecting piece 53 projecting to an upper portion of the base body 40 is continuously fixed to the upper portion of the rotating piece 22. The projecting piece 53 is positioned in a portion close to the fixed end of the hook 10 with respect to the center axis of the rating piece 22. Then, a rotating force is applied to the projecting piece 53 around the support point portion 21 to a direction of the fixed end of the hook 10, and the lower end portion of the rotating piece 22 resists the force by contacting with the portion close to the open end 11 of the hook 10. Accordingly, at the position other than the predetermined drop position, the state that the rotating piece 22 is brought into contact with the portion close to the open end 11 of the hook 10 can be maintained.

(Operating Portion)

The operating portion 50 is formed such as to comprise the projecting piece 53 fixed to the rotating piece 22 of the lock portion 20, a rotating function portion 51 contacting with the resistance portion 30 at the portion in front of the advancing direction of the base body 40 and rotating and moving the projecting piece 53, and a keeping function portion 52 for keeping a state that the projecting piece 53 rotates until the open portion of the hook 10 is positioned at a back side of the advancing direction of the base body 40 in comparison with the resistance portion 30. The rotating function portion 51 and the keeping function portion 52 is formed by a plate-like member having a vertical cross sectional shape thereof formed substantially in an L shape as shown in FIG. 1. Then, the rotating function portion 51 and the keeping function portion 52 are provided at a position substantially opposing to the resistance portion 30 with respect to the base body 40. More concretely speaking, the rotating function portion 51 is provided at a position in front of the advancing direction in comparison with the resistance portion 30 and capable of being brought into contact with the projecting piece 53. Further, the keeping function portion 52 is continuously formed to a position in which the end portion opposite to the rotating function portion 51 corresponds to the position at the back of the advancing direction of the resistance portion 30. Still further, a gap 54 having a height corresponding to a thickness of the projecting piece 53 is formed between the keeping function portion 52 and the base body 40.

(Resistance Portion)

In the predetermined drop position for dropping the premium within the casing 70, the plate-like resistance portion 30 extending to a direction of a peripheral edge from the portion close to the center portion of the base body 40 is provided at the position opposing to the base body 40 with respect to the hook 10 as shown in FIG. 2. The resistance portion 30 stands still from the predetermined drop position within the casing 70, and the base body 40 relatively moves with respect to the resistance portion 30.

The resistance portion 30 is provided with a main body portion 31 positioned below the hook 10, and a side supporting portion 32 projecting to a direction of the base body 40 from the main body portion 31. The side supporting portion 32 is provided at positions opposing to a left side edge and a right side edge of the hook 10. Further, an upper end portion of the side supporting portion 32 is positioned above the open end 11 of the hook 10. In accordance with this embodiment, as shown in FIG. 2, a notch portion is provided at a position corresponding to the hook 10 of the plate-like resistance portion 30, and it is structured such that the hook 10 can pass through the notch portion.

Further, the resistance portion 30, an illustration of which is omitted, is fixed to the predetermined drop position within the casing 70 through an elastic member in such a manner that the resistance portion 30 can be swung to a horizontal direction in the case that the premium 60 is in contact with the resistance portion 30. A contact sensor capable of detecting an oscillation of the resistance portion 30 is provided in a side portion of the resistance portion 30. Then, when the premium 60 is brought into contact with the resistance portion 30, the resistance portion 30 is horizontally swung so as to be brought into contact with the contact sensor and an oscillation of the resistance portion 30 can be detected, so that the contact sensor is turned on. Thereafter, when the premium 60 is released from the hook 10 so as to be supplied, it is detected that the resistance portion 30 is returned to the state in which the premium 60 is not in contact therewith, so that the contact sensor is turned off. Whether or not the premium 60 is supplied out is detected by these series of switching operations between on and off states. Then, in the case that the premium 60 is supplied out, the movement of the base body 40 is stopped. On the contrary, it is structured such that in the case that it is not detected that the resistance portion 30 is returned to the preceding state after the premium 60 is brought into contact with the resistance portion 30, and the premium 60 is not supplied out, an error state is judged, so that an error alarm is displayed and a supply motion is again performed. In this case, in accordance with this embodiment, whether or not the premium 60 is normally supplied out is detected by the contact sensor for detecting an oscillation of the resistance portion 30, however, in place thereof, there may be provided with a contact sensor for detecting whether or not the premium 60 passes through the discharge passage 80 or an optical sensor.

(Operation)

An operation of the invention will be described below with reference to FIG. 4.

1) The base body 40 moves toward the resistance portion 30.

In this state, the rotating piece 22 is brought into contact with the portion close to the open end 11 of the hook 10 and the open portion of the hook 10 is closed.

2) The projecting piece 53 projecting to the upper portion of the base body 40 is brought into contact with the rotating function portion 51.

3) The projecting piece 53 rotates to the direction opposite to the advancing direction around the support point portion 21.

4) Together therewith, the rotating piece 22 following to the projecting piece 53 also rotates, and the open portion of the hook 10 is opened.

5) When the base body 40 further moves toward the resistance portion 30, the projecting piece 53 passes through the gap between the base body 40 and the keeping function portion 52 in a rotating state.

6) The premium 60 is brought into contact with the resistance portion 30, and is stopped an integral movement with the hook 10.

7) In a state that the premium 60 stays in the portion close to the front portion of the advancing direction of the base body 40 in the resistance portion 30, the open end 11 of the hook 10 further moves to the back side of the advancing direction of the resistance portion 30.

8) The premium 60 is released from the hook 10, and the premium 60 is dropped down at the predetermined drop position within the casing 70.

9) The dropped premium 60 reaches the discharge port 81 through the discharge passage 80, and the premium 60 can be taken out to the outer portion of the casing 70.

Accordingly, by controlling the motion of the operating portion 50, the premium 60 can be dropped down from the hook 10 at the predetermined drop position, and the premium 60 can be prevented from dropping down from the hook 10 at the portion other than the predetermined drop position.

Further, since the resistance portion 30 is provided with the side supporting portion 32, a contact area between the resistance portion 30 and the premium 60 can be increased. Accordingly, the premium 60 can be easily taken out from the hook 10. Particularly, in the case that the premium 60 is suspended in the hook 10 by an easily deformable member such as a band-like member, when the premium 60 is brought into contact with the resistance portion 30, there is a case that the band-like member is bent and the premium 60 is hard to be taken out from the hook 10. However, since the side supporting portion 32 can be brought into contact with the bent band-like member, the premium 60 can be easily dropped down from the hook 10. Further, the rotating piece 22 can be rotated by a mechanical structure using the movement of the base body 40.

(Variation)

The lock mechanism for the hook in accordance with the invention can be used even in the case the rotating axis of the base body 40 has an inclined angle with respect to the vertical direction. Further, the base body 40 may be at a standstill and the resistance portion 30 may move. still further, the base body 40 and the resistance portion 30 may move at a different rotating speed and in a different rotating direction. Furthermore, in accordance with this embodiment, the rotating piece 22 is rotated by the operating portion having a base-like structure using the movement of the base body 40, however, the rotating piece 22 may be electrically operated.

In accordance with the invention as recited in claim 1, there is provided a lock mechanism for a hook in which a premium can be taken out from a hook at a predetermined drop position within a casing and the premium is prevented from dropping down from the hook at the other position than the predetermined drop position.

Further, in accordance with the invention as recited in claim 2, there is provided a lock mechanism for a hook in which a premium can be taken out from a hook at a predetermined drop position within a casing even in the case that the hook relatively moves with respect to the predetermined drop position and the premium is prevented from dropping down from the hook at the other position than the predetermined drop position.

Still further, in accordance with the invention as recited in claim 3, there is provided a lock mechanism which can securely take out a premium from a hook.

Furthermore, in accordance with the invention as recited in claim 4, there is provided a lock mechanism which can be easily mounted to a base body.

Moreover, in accordance with the invention as recited in claim 5, there is provided a premium supply apparatus in which a premium can be taken out from a hook at a predetermined drop position within a casing and the premium is prevented from dropping down from the hook at the other position than the predetermined drop position.

FIELD OF INDUSTRIAL USE

This invention is utilized in the field of industry of Game machine, especially premium supply apparatus and a lock mechanism for a hook of game machine.

What is claimed is:

1. A lock mechanism for dropping down a premium suspended in a base body at a predetermined drop position and for preventing the premium from dropping down at a position other than said predetermined drop position, comprising:

a base member;

a hook fixed to the base body, suspending the premium and capable of maintaining a state of being easily dropped; and a lock portion for preventing the premium from dropping down by closing an open portion in the hook, wherein the lock portion comprises a support point portion axially supported to the base body, a rotating piece capable of rotating to both of normal and inverse directions around the support point portion and an operating portion for rotating the rotating piece, and wherein said rotating piece is structured such that an end portion thereof is brought into contact with the hook at the position other than the predetermined drop position so as to close the open portion and at the predetermined position, the rotating piece is rotated to a position which does not prevent the premium from dropping down from the hook so that the premium can be taken out.

2. A lock mechanism for a hook as recited in claim 1, wherein a resistance portion relatively moving with respect to the base body is provided at the predetermined drop position for dropping down the premium, and wherein the resistance portion is formed in a shape for guiding the premium to the open portion in the hook by contacting with the premium and is provided at the position which does not prevent the premium from dropping down from the hook.

3. A lock mechanism for a hook as recited in claim 2, wherein the resistance portion is provided with a main body portion positioned at an opposite side to the base body with respect to the hook and contacting with the premium, and wherein a side support portion projecting to a direction of the base body from the main body portion, and the side support portion is formed in such a manner that an upper end portion thereof is at a position higher than an open end of the hook in the predetermined drop position.

4. A lock mechanism for a hook as recited in claim 2, wherein the operating portion comprises:

a projecting piece fixed to a rotating piece of the lock portion;

a rotating function portion contacting with the projecting piece in a front side of an advancing direction of the base body so as to rotate and move the projecting piece with respect to said resistance portion; and a keeping function portion for keeping a state that the projecting piece rotates until the open portion of the hook is positioned at a back side of the advancing direction of the base body in comparison with the resistance portion.

5. A premium supply apparatus comprising:

a box-like casing;

a base body provided within the casing;

a hook fixed to the base body, suspending a premium and capable of maintaining a state of being easily dropped;

a lock portion for preventing the premium from dropping down by closing an open portion in the hook;

a resistance portion relatively moving with respect to the base body provided at a predetermined drop position for dropping down the premium within said casing; and a discharge passage for discharging the premium dropping down said predetermined drop position to an outer portion of the casing, and a discharge port disposed at an end portion of the discharge passage and communicating with the outer portion of the casing, wherein said lock portion comprise s a support point portion axially supported to the base body, a rotating piece capable of rotating to both of normal and inverse directions around the support point portion and an operating portion for rotating the rotating piece, wherein said rotating piece is structured such that an end portion thereof is brought into contact with the hook at the position other than the predetermined drop position so as to close the open portion and at the predetermined position, the rotating piece is rotated to a position which does not prevent the premium from dropping down from the hook so that the premium can be taken out, and wherein said resistance portion is formed in a shape for guiding the premium to the open portion in the hook by contacting with the premium and is provided at the position which does not prevent the premium from dropping down from the hook.

6. A lock mechanism for a hook as recited in claim 3, wherein the operating portion comprises:

a projecting piece fixed to a rotating piece of the lock portion;

a rotating function portion contacting with the projecting piece in a front side of an advancing direction of the base body so as to rotate and move the projecting piece with respect to said resistance portion; and a keeping function portion for keeping a state that the projecting piece rotates until the open portion of the hook is positioned at a back side of the advancing direction of the base body in comparison with the resistance portion.

* * * * *